US006294871B1

(12) United States Patent
Scott et al.

(10) Patent No.: US 6,294,871 B1
(45) Date of Patent: Sep. 25, 2001

(54) ULTRAVIOLET AND VISIBLE FILTER FOR CERAMIC ARC TUBE BODY

(75) Inventors: Curtis E. Scott, Mentor; H. Michael Laska, Willoughby; Mary Sue Kaliszewski, Lyndhurst, all of OH (US); Csaba F. Rappensberger, Dunakeszi (HU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/235,647

(22) Filed: Jan. 22, 1999

(51) Int. Cl.[7] ..... H01J 17/16
(52) U.S. Cl. ..... 313/636; 445/17
(58) Field of Search ..... 313/112, 25, 634, 313/635, 636, 637; 65/66, 86, 134.1; 445/17, 26, 23

(56) References Cited

U.S. PATENT DOCUMENTS

| | | | | |
|---|---|---|---|---|
| 2,582,453 | | 1/1952 | Pincus . | |
| 2,862,131 | | 11/1958 | Escher-Desrivieres . | |
| 3,148,300 | | 9/1964 | Graff . | |
| 3,988,628 | * | 10/1976 | Clausen | 313/112 |
| 5,252,886 | * | 10/1993 | Renardus et al. | 313/634 |
| 5,424,609 | * | 6/1995 | Geven et al. | 313/634 |
| 5,698,948 | * | 12/1997 | Caruso | 313/637 |
| 5,751,111 | | 5/1998 | Stoffels et al. . | |

FOREIGN PATENT DOCUMENTS 0 587 238 A1 9/1993 (EP) .

* cited by examiner

*Primary Examiner*—Nimeshkumar D. Patel
*Assistant Examiner*—Todd Reed Hopper
(74) *Attorney, Agent, or Firm*—Fay, Sharpe, Fagan, Minnich & McKee, LLP

(57) ABSTRACT

A ceramic arc tube for a metal halide discharge lamp is soaked in a dopant solution. The dopant solution includes a salt of a UV-absorbing additive, such as europium, cerium, or titanium. The salt is converted to the oxide form of the UV-absorbing additive during sintering of the arc tube. Lamps fabricated using the doped arc tubes filter UV from light emitted from the discharge without appreciably absorbing light in the visible range. The UV retained in the lamp causes the lamp to run at a hotter temperature, improving light output.

20 Claims, 2 Drawing Sheets

ULTRAVIOLET AND VISIBLE FILTER FOR CERAMIC ARC TUBE BODY

BACKGROUND OF THE INVENTION

The present invention relates to UV absorbing arc tube bodies for use in electric lamps. It finds particular application in conjunction with ceramic metal halide arc tubes, and will be described with particular reference thereto. It should be appreciated, however, that the invention is also applicable to other lamp envelopes and shrouds for lamps having a source of light which emits both UV and visible light radiation, such as those constructed of single crystal sapphire or quartz.

Metal halide lamps are typically constructed of a fused silica (quartz) arc tube containing a fill of a light emitting metal, such as sodium, commonly in the form of the halide, and optionally mercury. The lifetime of such lamps is often limited by the loss of the metal portion of the metal halide fill during lamp operation due to metal ion diffusion, or reaction of the metal halide with the fused silica arc tube, and a corresponding build-up of free halogen in the arc tube.

The mobility of the sodium is such that the quartz arc tubes are relatively porous to it. During lamp operation, sodium passes from the hot plasma and through the arc tube wall to the cooler region between the arc tube and the outer jacket or envelope. The lost sodium is thus unavailable to the discharge and can no longer contribute its characteristic emission. The light output consequently diminishes and the color shifts from white toward blue. The arc becomes constricted and, particularly in a horizontally operating lamp, may bow against the arc tube wall and soften it. Also, loss of sodium causes the operating voltage of the lamp to increase and it may rise to the point where the arc can no longer be sustained, ending the life of the lamp.

Ceramic arc tubes have recently been developed which provide advantages over quartz arc tubes. Ceramic arc tubes are formed from densely sintered polycrystalline metal oxide, such as aluminum oxide, yttrium-aluminum garnet, or yttrium oxide, or a monocrystalline metal oxide, such as sapphire. U.S. Patent Nos. 5,424,609; 5,698,948; and 5,751,111 provide examples of such arc tubes. Ceramic arc tubes are less porous to sodium ions than quartz and thus retain the metal within the lamp. They are also able to withstand much higher operating temperatures than quartz arc tubes. While quartz arc tubes are limited to operating temperatures of around 950–1000° C., due to reaction of the halide fill with the glass, ceramic arc tubes are capable of withstanding operating temperatures of 1700 to 1900° C. The higher operating temperatures provide better color rendering and higher lamp efficiency.

Ceramic arc tubes are constructed of a number of separate parts which are extruded or die pressed from a ceramic powder, mixed with an organic binder. European patent Application No. 0 587 238 A1, for example, discloses a ceramic discharge tube of translucent aluminum oxide. Typically, the parts are tacked together with an adhesive and then sintered to form cohesive gas-tight joints between the components.

Both quartz and ceramic electric arc discharge lamps having mercury in the arc discharge emit ultraviolet (UV) radiation which at wavelengths below 320 nm are harmful to the human eye, fabrics, plastics and other materials. One way of reducing UV in metal halide lamps is to surround the arc tube with a fixture having a UV absorbing lens or an outer glass jacket which contains UV absorbing materials, a costly additional step.

Dopants have been used in quartz lamps to absorb UV radiation emitted by the light source. Examples are disclosed in U.S. Pat. Nos. 2,582,453, 2,862,131, and 3,148,300. Many of the UV absorbers used in the quartz glass result in a color change. For example, U.S. Pat. No. 2,862,131 discloses green or brown tinted glass.

The present invention provides a new and improved UV-absorbing arc tube body which overcomes the above referenced problems and others.

SUMMARY OF THE INVENTION

In accordance with one aspect of the present invention, a UV-attenuating discharge vessel for an arc discharge lamp is provided. The vessel includes an arc tube body which defines a discharge space for receiving a metal halide fill. The body is constructed from a ceramic material doped with a UV-attenuating additive.

In accordance with another aspect of the present invention, a visible light transmissive, UV light attenuating metal halide lamp is provided. The lamp includes an envelope and a discharge vessel received in the envelope. The vessel includes an arc tube body which defines a chamber, the body being constructed from a ceramic material doped with a UV-attenuating additive. Electrodes extend into the chamber and a fill is sealed within the chamber. The fill includes a metal halide for initiating and sustaining an arc discharge.

In accordance with yet another aspect of the present invention a method of forming a UV-attenuating arc tube body for a metal halide discharge lamp is provided. The method includes forming a porous arc tube body from a mixture which includes powdered alumina and infiltrating a dopant into the porous arc tube body, the dopant including a salt of a UV-absorbing additive. The method further includes sintering the doped porous arc tube body at a sufficient temperature and for a sufficient time for the alumina to become substantially translucent and for the salt to be converted to the UV attenuating additive.

One advantage of the present invention is that UV radiation is filtered from light emitted from a ceramic metal halide lamp without appreciably changing the color of the light.

Another advantage of the present invention is that the UV absorbed by the walls of the arc tube heats up the body allowing the arc tube to run at a higher temperature.

Another advantage of the present invention is that a UV-filtering glass shroud or lens surrounding the lamp is not necessary.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
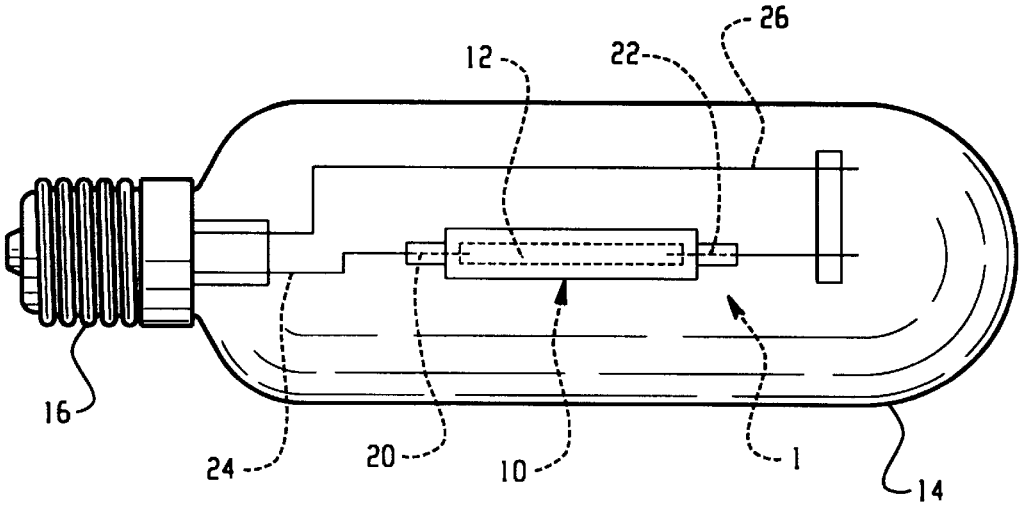
FIG. 1 is a side view of a metal halide lamp according to the present invention.

With reference to FIG. 1, a, high-pressure metal halide lamp is provided with a discharge vessel 1, including an arc tube body 10 which encloses a chamber or discharge space 12. The discharge space preferably contains a fill which comprises at least one metal halide, such as sodium iodide, thallium iodide or dysprosium iodide, in addition to mercury and a rare gas, such as Argon or Xenon. Other suitable fills, for initiating and sustaining an arc discharge, known in the art, are also contemplated. The discharge vessel is enclosed in an outer envelope 14, which is provided with a lamp cap 16 at one end.

First and second internal electrodes 20, 22 extend into the discharge space 12. The electrodes are formed from tungsten, or other known electrode material. A discharge forms between the electrodes when the lamp is in an operational state. Current conductors 24 and 26 connect the electrodes 20 and 22, respectively, to first and second electrical contact forming parts of the cap 16.

Figure 2:
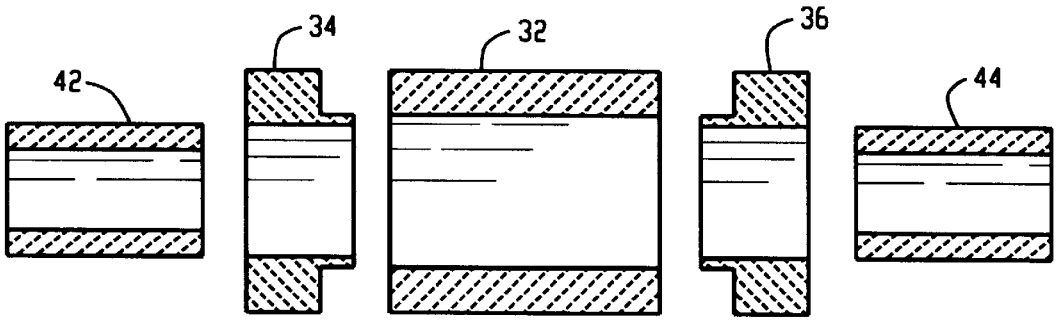
FIG. 2 is a side view of an unassembled ceramic arc tube body according to one embodiment of the present invention.
Figure 3:
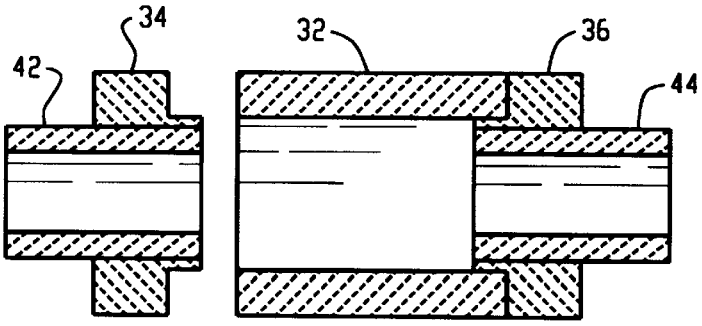
FIG. 3 is an side view of a partially assembled ceramic arc tube according to the embodiment of FIG. 2.
Figure 4:
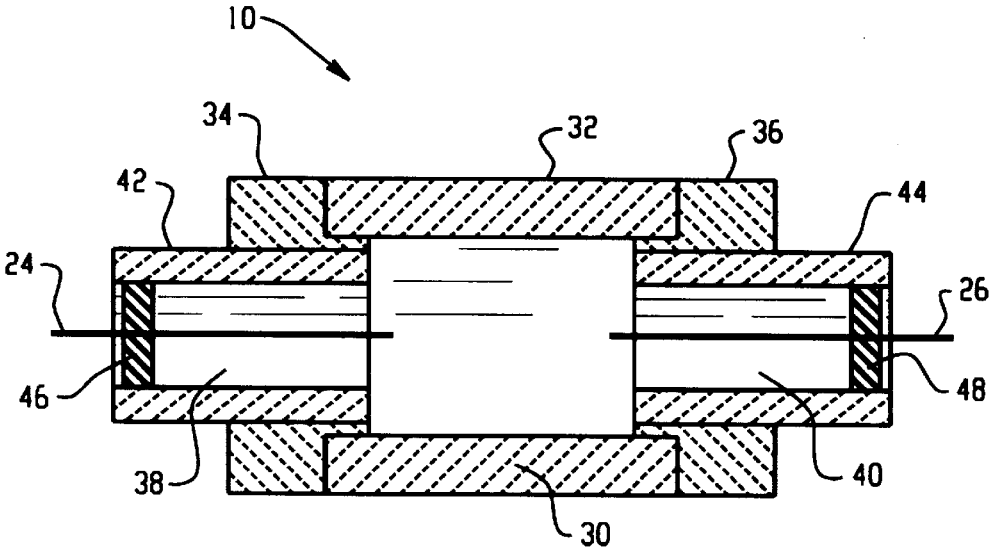
FIG. 4 is a side view of the ceramic arc tube body of FIG. 3.

With reference also to FIGS. 2, 3, and 4, the ceramic arc tube body 10 (not to scale) includes a ceramic wall 30 which is doped with a UV-attenuating additive. The wall includes a cylindrical portion 32 with end wall portions 34 and 36 at either end, although other arc tube shapes are also contemplated. Each of the end wall portions defines an opening 38, 40. A first tube 42 and a second tube 44 extend outwardly from the end wall portions 34 and 36 and are connected to the end walls around the openings. The current conductors 24 and 26 are received by the first and second tubes. The conductors are sealed into the tubes with seals 46 and 48 to create a gas-tight discharge space.

The cylindrical portion, end wall portions and also the first and second tubes are preferably formed from a polycrystalline metal oxide or monocrystalline metal oxide, such as polycrystalline aluminum oxide ceramic or single crystal sapphire, although other ceramic materials capable of withstanding high wall temperatures up to 1700–1900° C. and resistant to attack by the fill materials are also contemplated.

For ease of reference, the description will refer to the preparation of aluminum oxide (alumina) arc tube bodies. It should be understood, however, that single crystal sapphire arc tube bodies or other ceramic bodies are similarly prepared.

As shown in FIGS. 2–4, the arc tube body 10 is readily assembled from separate components, each component corresponding to one of the first and second tubes 42, 44, end wall portions 34,36, and cylindrical portion 32. The components are fabricated by die pressing or extruding a mixture of a ceramic powder and an organic binder. Assembly of the arc tube body involves placement and tacking of the components, followed by partial sintering. With particular reference to FIG. 3, the first and second tubes are tacked to the respective end portions with an adhesive and the end portions are tacked to the cylindrical portion. The tacked components are then sintered at a temperature of around 1300° C. to form gas-tight joints. During this partial sintering, the components shrink slightly and lock together.

Figure 5:
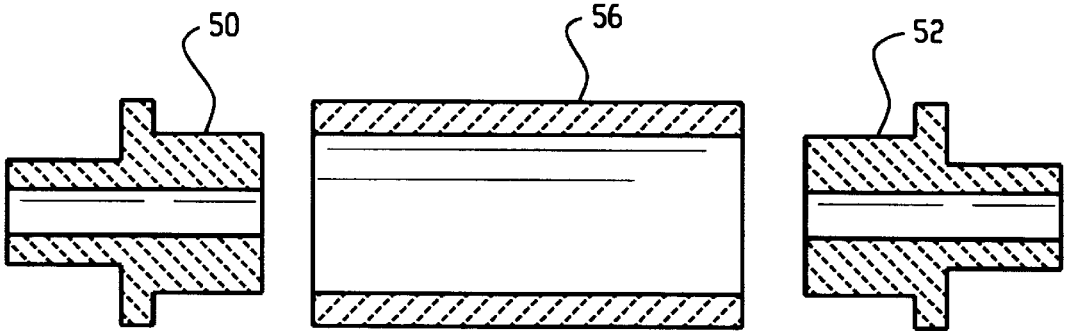
FIG. 5 is a side view of an unassembled ceramic arc tube body according to another embodiment of the present invention.

With reference to FIG. 5, the body is alternatively formed from only three components. Two combined tube and end wall portions 50 and 52 are formed by injection molding. A cylindrical tubular portion 56, corresponding to the cylindrical portion 32 of the finished arc tube, is formed by extruding a continuous cylindrical tube and then cutting the tube into the desired length for the body portion. The parts are tacked and sintered as described before.

The partially sintered (or "green ceramic") arc tube body preferably has an alumina content of about 99.99%, with magnesia (MgO) present at about 400–1500 ppm. The magnesia imparts transparency to the body when fired.

The doped ceramic arc tube body is preferably prepared by infiltrating a dopant solution into the partially-sintered arc tube body and then firing the resulting doped arc tube body. The partially sintered alumina matrix is porous and readily absorbs the dopant solution into its structure.

The dopant solution includes the UV-attenuating additive, preferably in the form of a salt, such as a nitrate or a chloride. The dopant solution may also include other additives which aid in formation of the arc tube. Soaking times of 15 minutes to 22 hrs provide for good absorption of the dopant. Optionally, a vacuum is applied to improve absorption of the dopant solution.

The doped arc tube is dried at room temperature overnight or in an oven at about 70° C. for about 3 hours to evaporate water from pores of the arc tube. The arc tube is fired at 800–1100° C. During firing, the dopant is converted to the oxide form of the UV-attenuating additive. The doped arc tube is then fired at a temperature of about 1860–1880° C. for about three hours in a hydrogen atmosphere. The partially sintered ceramic is converted to a translucent polycrystalline aluminum oxide.

In an alternative embodiment, the dopant solution is infiltrated into components of the arc tube body prior to partial sintering. In this case, the dopant solution may be incorporated into a binder solution which maintains the integrity of the arc tube during partial sintering. Preferably, at least the cylindrical portion 32 is soaked in the dopant. Other components may be doped or used without doping. The doped parts are then dried, then sintered at a temperature of around 800–1300° C. The dopant is converted to the oxide form of the UV-attenuating additive. Other additives, including the binder, are burned off at this temperature.

The doped arc tube is then fired at a temperature of about 1860–1880° C. for about three hours in a hydrogen atmosphere. The partially sintered ceramic is converted to a translucent polycrystalline aluminum oxide. Shrinkage of the components is used advantageously in forming gas-tight joints.

U.S. Pat. Nos. 5,424,609, 5,698,948, and 5,751,111 disclose alternative arc tube bodies which may be used, and are incorporated herein by reference.

Ceramic bodies doped with europium oxide ($Eu_2O_3$), titanium dioxide ($TiO_2$), cerium oxide (CeO ), $_2$or combinations thereof, show good attenuation properties. Oxides of lanthanum, dysprosium and neodymium and other rare earth metals and transition elements may also provide UV attenuation. Chromium, cobalt, and copper tend to absorb light in the visible range, but are effective, either alone or in combination with other UV-attenuating additives, particularly when colored light is acceptable or desired. For example, chromium tends to impart a ruby color to the reflected light, while cobalt imparts a blue color.

At high concentrations of the UV-attenuating additive, the ceramic arc tube loses its translucency. Accordingly, the concentration of the UV-attenuating additive in the ceramic arc tube is preferably below about 5000 ppm. More preferably, the concentration of the UV-attenuating additive is between about. 500 and about 2500 ppm. The concentration of the UV-attenuating additive is readily adjusted by varying the concentration of the dopant, the rate of infiltration, or the length of the soaking time.

The doped ceramic arc tubes produced in this manner show good UV attenuation. Ceramic metal halide lamps fabricated with the doped ceramic tubes show total-UV attenuation comparable to, or better than, that of conventional "blue quartz" UV-absorbing lamps. They also exhibit good lamp life. The doped ceramic lamps run at hotter temperatures than lamps having un-doped ceramic tubes, as evidenced from measurements of operating voltages.

While not intending to limit the invention, the following examples demonstrate the concentrations of dopants which may be achieved in ceramic arc tube bodies and the UV transmissions of ceramic metal halide lamps formed from the doped arc tube bodies.

EXAMPLE 1

Partially sintered arc tube bodies were doped with europium, titanium or cerium by soaking unfired ceramic bodies or tubing in solutions of the respective metal nitrate-hexahydrates in ion-exchanged water. Soaking was carried out either with application of a vacuum or without (normal). TABLE 1 provides doping solution concentrations and corresponding arc tube concentrations.

TABLE 1

Analysis Results of Sintered Alumina Ceramics

| Dopant | Soaking Method | Soaking Period | Conc. in fired ceramic ppm |
|---|---|---|---|
| Cerium | normal | 22 hrs | 930–1000 |
| Cerium | vacuum | 15 min | 590–650 |
| Europium | vacuum | 16 min | 77 |
| Europium | vacuum | 15 min | 320 |
| Europium | vacuum | 15 min | 620 |
| Europium | vacuum | 15 min | 1200 |
| Titanium | vacuum | 15 min | 390 |

EXAMPLE 2

Metal halide lamps of the type shown in FIG. 1 were fabricated from doped ceramic arc tube bodies 10 prepared according to the method of Example 1. TABLE 2 provides a comparison between the UV attenuation of doped and un-doped ceramic lamps.

TABLE 2

UV Transmission of Doped and Un-doped (control) Ceramic Metal Halide Lamps

| Sample | Dopant ppm | Transmission (percent of control) UV A 315–400 nm | UV B 280–315 nm | UV C 250–280 nm |
|---|---|---|---|---|
| Control | 0 | 100 | 100 | 100 |
| Eu 1 | 680 (Eu) | 40.94 | 13.52 | 10.13 |
| Eu 2 | 1000 (Eu) | 34.68 | 12.72 | 9.38 |
| Ce 1 | 210 (Ce) | 96.28 | 60.76 | 45.55 |
| Ce 2 | 640 (Ce) | 77.31 | 21.64 | 12.36 |

As shown in TABLE 2, the Europium doped lamps exhibited better UV attenuation than the Cerium doped lamps at the dopant concentrations used in the Example while each showed significant improvement over the un-doped control.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A UV-attenuating discharge vessel for an arc discharge lamp comprising:

an arc tube body which defines a discharge space for receiving a metal halide fill, the body being constructed from a ceramic material selected from the group consisting of polycrystalline metal oxides and monocrystalline metal oxides and being doped with a UV-attenuating additive which includes europium oxide.

2. A UV-attenuating discharge vessel for an arc discharge lamp comprising:

an arc tube body which defines a discharge space for receiving, a metal halide fill the body being constructed from a ceramic material doped with a UV-attenuating additive, the UV-attenuating additive being at a concentration of less than about 5000 ppm.

3. The vessel of claim 2, wherein the uv-attenuating additive is at a concentration of between about 500 and about 2500 ppm.

4. The vessel of claim 3, wherein the uv-attenuating additive is europium oxide at a concentration of between about 1000 and about 1500 ppm.

5. A UV-attenuating discharge vessel for an arc discharge lamp comprising:

an arc tube body which defines a discharge space for receiving a metal halide fill, the body constructed from a ceramic material selected from the group consisting of polycrystalline metal oxides and monocrystalline metal oxides and being doped with a UV attenuating additive, the arc tube body further comprising magnesia at a concentration of about 400–1500 ppm.

6. A visible light transmissive, UV light attenuating metal halide lamp comprising:

an envelope;

a discharge vessel received in the envelope, the vessel including:

an arc tube body which defines a chamber, the body being constructed from a ceramic material doped with a UV-attenuating additive the UV-attenuating additive which includes an oxide of a lanthanide series element selected from the group consisting of lanthanum, cerium, europium, dysprosium, neodymium and combinations thereof;

electrodes extending into the chamber; and, a fill sealed within the chamber, the fill including a metal halide for initiating and sustaining an arc discharge.

7. The lamp of claim 6, wherein the UV-attenuating additive includes an europium oxide.

8. The lamp of claim 6, wherein the UV-attenuating additive is at a concentration of less than about 5000 ppm.

9. The lamp of claim 8, wherein the UV-attenuating additive is at a concentration of between about 500 and about 2500 ppm.

10. The lamp of claim 9, wherein the UV-attenuating additive is europium oxide at a concentration of between about 1000 and about 1500 ppm.

11. The lamp of claim 6, wherein the arc tube body filters at least about 70 percent of UV light emitted by the discharge.

12. The lamp of claim 6, wherein the metal halide includes sodium iodide.

13. The lamp of claim 12 wherein the fill further comprises mercury.

14. A method of forming a UV-attenuating arc tube body for a metal halide discharge lamp, the method comprising:

forming a porous arc tube body from a mixture which includes powdered alumina;

infiltrating a dopant into the porous arc tube body, the dopant including a salt of a UV-absorbing additive; and sintering the doped porous arc tube body at a sufficient temperature and for a sufficient time for the alumina to become substantially translucent and for the salt to be converted to the UV attenuating additive.

15. The method of claim 14, wherein the step of infiltrating the dopant includes:

adding the dopant to a binder solution;

soaking at least a component of the porous arc tube body in the binder solution including the dopant;

evaporating water from the doped component of the porous arc tube body; and, wherein the step of forming a porous arc tube body from a mixture which includes powdered alumina includes assembling the porous arc tube from at least the doped component.

16. The method of claim 14, wherein the step of infiltrating the dopant includes:

heating the porous arc tube body to a temperature of at least about 1100° C. and then, soaking the porous arc tube body in the dopant the ceramic material being selected from the group consisting of polycrystalline metal oxides and monocrystalline metal oxides.

17. A UV-attenuating discharge vessel for an arc discharge lamp comprising:

an arc tube body which defines a discharge space for receiving a metal halide fill, the body being constructed from a ceramic material doped with a UV-attenuating additive, the UV-attenuating additive including an oxide of a lanthanide series element selected from the group consisting of cerium, europium, lanthanum, dysprosium, neodymium, and combinations thereof.

18. The vessel of claim 17, wherein the UV-attenuating additive includes europium oxide.

19. An arc tube body for an arc discharge lamp which defines a discharge space for receiving a metal halide fill, the body being constructed from a ceramic material doped with a UV-attenuating additive by a process which includes:

infiltrating a dopant solution into a porous arc tube body, the dopant solution including a compound which is convertible to the UV-absorbing additive; and converting the compound to the UV-attenuating additive.

20. A method of forming a UV-attenuating arc tube body for a metal halide discharge lamp, the method comprising:

forming a porous arc tube body which is permeable to a dopant solution;

infiltrating a dopant solution into the porous arc tube body, the dopant solution including a salt of a UV-absorbing additive; and sintering the doped porous arc tube body at a sufficient temperature and for a sufficient time for the salt to be converted to the UV attenuating additive.

* * * * *

UNITED STATES PATENT AND TRADEMARK OFFICE

CERTIFICATE OF CORRECTION

PATENT NO. : 6,294,871 B1
DATED : September 25, 2001
INVENTOR(S) : Curtis E. Scott et al.

It is certified that error appears in the above-identified patent and that said Letters Patent is hereby corrected as shown below:

Column 6,
Line 23, after "receiving" delete -- , --; and after "fill", insert -- , --.

Column 7,
Line 33, after "1100° C. insert -- ; -- before the word "and"; and
Line 34 to Column 8, line 2, delete -- the ceramic material being selected from the group consisting of polycrystalline metal oxides and monocrystalline metal oxides --.

Signed and Sealed this

Fourteenth Day of May, 2002

*Attest:*

*Attesting Officer*

JAMES E. ROGAN
*Director of the United States Patent and Trademark Office*